United States Patent [19]

McClure

[11] Patent Number: 4,831,902

[45] Date of Patent: May 23, 1989

[54] BROKEN BOLT EXTRACTOR

[76] Inventor: John H. McClure, 7170 Plainview Rd., Hillsboro, Ohio 45133

[21] Appl. No.: 179,961

[22] Filed: Apr. 11, 1988

[51] Int. Cl.[4] ..... B25B 13/50

[52] U.S. Cl. ..... 81/53.2; 29/426.4; 408/115 R

[58] Field of Search ..... 81/53.2; 29/426.4, 426.5, 29/240, 256, 271, 402.3; 408/241 G, 1 R, 72 R, 72 B, 79, 115 R, 115 B

[56] References Cited

U.S. PATENT DOCUMENTS

| | | | |
|---|---|---|---|
| 1,227,391 | 5/1917 | Cooper . | |
| 2,165,485 | 7/1939 | Jackman | 29/426.4 X |
| 2,281,164 | 4/1942 | Maling | 81/53.2 |
| 2,547,986 | 4/1951 | Dermark | 29/426.4 |
| 2,670,639 | 3/1954 | Flowers et al. . | |
| 2,684,526 | 7/1954 | Hoover . | |
| 2,686,447 | 8/1954 | Vock et al. . | |
| 2,744,311 | 5/1956 | Nipken et al. . | |
| 2,744,312 | 5/1956 | Conger . | |

*Primary Examiner*—Debra Meislin

[57] ABSTRACT

A tool and method for extracting a broken bolt shank, stud or other threaded member from a mating tapped hole is described wherein a segment of threaded rod having a plurality of off-axis longitudinal holes therethrough is threaded against or otherwise held in axial abutting relationship with the end of the broken bolt shank to be removed, alignment holes are drilled into the shank using the threaded rod segment as a guide, an alignment pin is inserted through each alignment hole to pin the threaded rod segment to the shank, and the shank and threaded rod segment are simultaneously backed out of the tapped hole by applying torque to the segment using one or a pair of nuts locked on the threaded rod segment or using a screwdriver wrench engaging one end of the threaded rod segment.

13 Claims, 1 Drawing Sheet

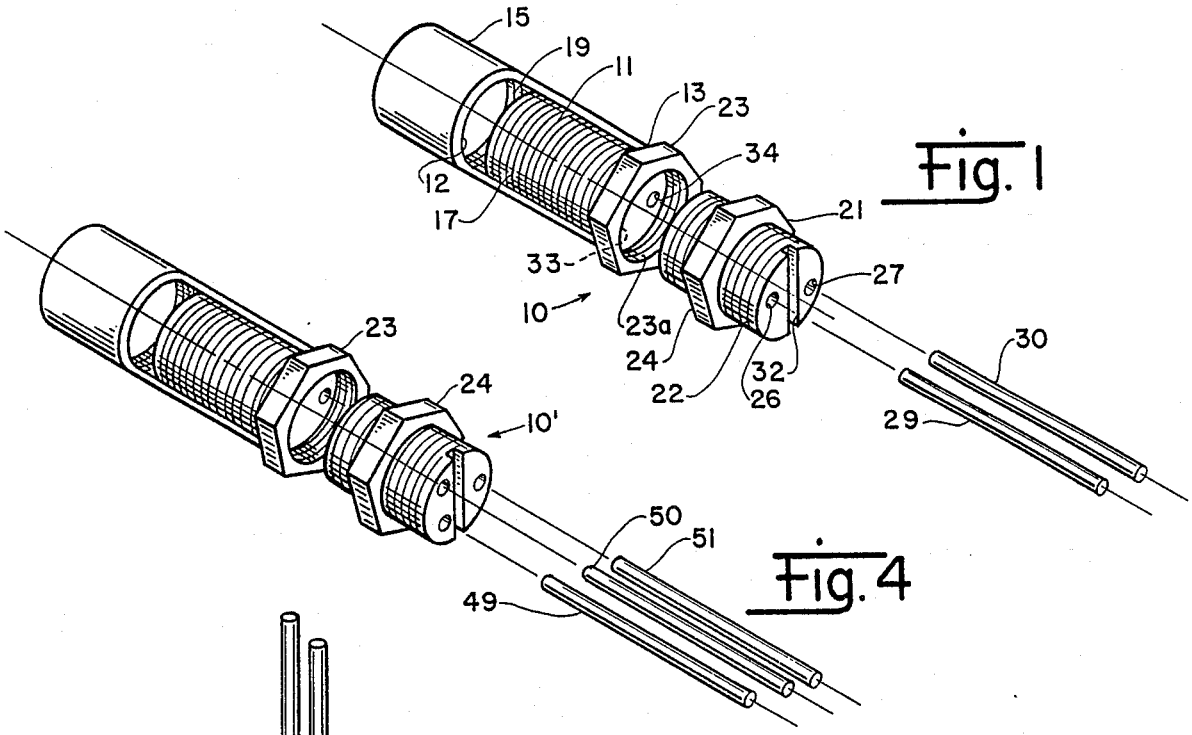
Fig. 1
Fig. 4
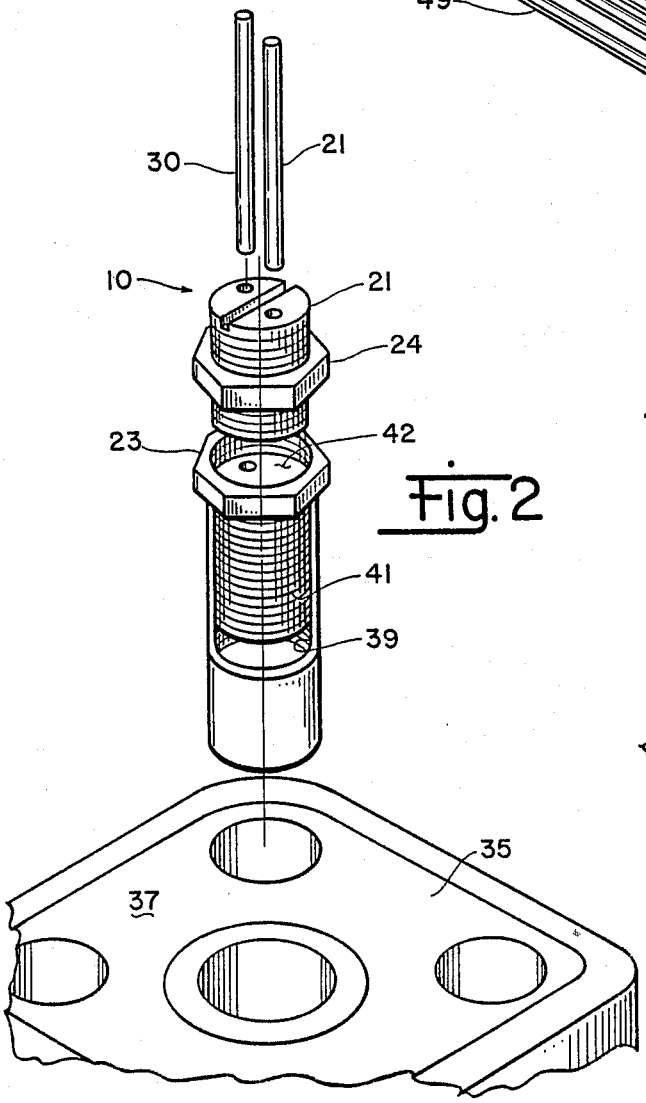
Fig. 2
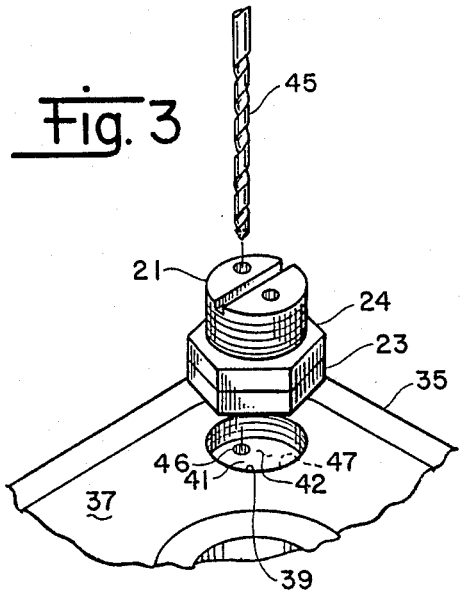
Fig. 3

BROKEN BOLT EXTRACTOR

BACKGROUND OF THE INVENTION

1. Field of the Invention

The present invention relates generally to devices and methods for extracting broken bolts or other threaded studs from a tapped hole, and more particularly to novel tool and method for removing a broken bolt, threaded stud, or other threaded member from a tapped hole, the bolt or stud having been broken off above, below or flush with the surface defining the tapped hole.

2. Description of Prior Art

Various devices and methods have been proposed in the prior art for removal of the shank of a broken bolt, threaded stud or the like from a mating tapped hole into which the bolt or stud is threaded. Representative of prior art devices is the familiar "Ezy-Out" tool comprising a tapered metallic member having on its tapered surface a plurality of helical flutes defining edges for engaging the wall of a hole drilled axially into the broken bolt shank so that the shank may be backed out by rotation of the tool. The straight shank or chisel type tools have longitudinal edges for engaging the walls of an axial hole drilled into the broken bolt shank. Other related devices and methods for the removal of broken bolt shanks, studs and the like may be represented by those described in or reference by U.S. Pat. No. 1,227,391 to Cooper describing device and method for removing a pipe wherein an elongate threaded member having a tapered end and a pair of diametrically opposed longitudinal slots is inserted into the pipe and a pair of tapered wedges are tapped into the slots to engage the inner surface of the pipe so that the pipe may be backed out; U.S. Pat. No. 2,670,639 to Flowers et al describing a tool for removing a broken spark plug from an engine cylinder, the tool having an offset for insertion into a hole with an offset drilled into the broken spark plug to back the plug out of the cylinder head of the engine; U.S. Pat. No. 2,684,526 describing a tool having three centering points on one end which when struck against the end of a broken bolt shank provides three indents for drilling holes into the shank for receiving the three pointed tool; U.S. Pat. No. 2,686,447 to Vock et al describing a stud extractor in the form of an elongate tool with an offset defining a key insertable in a corresponding hole provided in the broken stud; U.S. Pat. No. 2,744,311 to Nipken et al and U.S. Pat. No. 2,744,312 to Conger each describing a tool for extracting a broken drill or the like including finger members which are forced down into the flutes of the broken drill inside the hole so that the broken drill may be grasped and removed.

Each of the prior art devices just described suffer from one or more shortcomings seriously impairing utility thereof for the intended purpose. In the prior art devices and methods, the end of the broken bolt shank to be removed must be accessible for drilling a hole for insertion of the extractor tool. In most of the cases, the extractor tool is driven into the drilled hole with sufficient force to engage the wall thereof. Many of the prior art tools have a very short axial extent of engagement with the wall of the drilled hole, and axial alignment of the tool with the drilled hole may therefore be difficult to control with desired precision. The operation of driving the tool into the drilled hole frequently results in deformation of the threads of the tapped hole, in radially outward deformation of the drilled bolt shank against the threads of the tapped hole, and in consequent increased difficulty in backing the broken bolt shank out.

SUMMARY OF THE INVENTION

The present invention substantially solves problems of prior art devices as just stated by providing novel tool and method for removal of a broken bolt, threaded stud or other threaded member from a tapped hole.

It is a principal object of the invention to provide an improved tool for removing a broken bolt shank, threaded stud or the like.

It is a further object of the invention to provide a tool for removing a broken bolt or the like from a blind or otherwise substantially inaccessible location.

It is yet a further object of the invention to provide an improved method for removing broken bolt shanks, studs or other threaded members from mating tapped holes.

In accordance with the stated principles and objects of the invention, a tool and method for extracting a broken bolt shank, stud or other threaded member from a mating tapped hole is described wherein a segment of threaded rod having a plurality of off-axis longitudinal holes therethrough is threaded against or otherwise held in axial abutting relationship with the end of the broken bolt shank to be removed, alignment holes are drilled into the shank using the threaded rod segment as a guide, an alignment pin is inserted through each alignment hole to pin the threaded rod segment to the shank, and the shank and threaded rod segment are simultaneously backed out of the tapped hole by applying torque to the segment using one or a pair of nuts locked on the threaded rod segment or using a screwdriver wrench engaging one end of the threaded rod segment.

DESCRIPTION OF THE DRAWINGS

The invention will be best understood from the detailed written description of representative embodiments hereinafter presented and read in conjunction with the accompanying drawings wherein like parts are identified throughout by like identifying numerals, and wherein:

FIG. 1 is a perspective view of the components of one embodiment of the invention shown applied to a broken bolt shank disposed within a tapped hole;

FIG. 2 is a view partially exploded of the FIG. 1 embodiment applied to broken bolt shank disposed within a tapped hole in a surface of a cylinder block of an engine;

FIG. 3 is a view of the FIG. 1 embodiment of the invention disposed near a tapped hole containing a broken bolt shank to illustrate the method of removing a broken bolt according to the invention; and FIG. 4 is a perspective view similar to that of FIG. 1 of another embodiment of the invention.

DETAILED DESCRIPTION OF PREFERRED EMBODIMENTS

Referring now to the drawings, FIG. 1 shows in perspective a representative embodiment of the extractor tool of the invention useful in removing broken bolt shanks, threaded studs or the like from tapped holes. It must be noted at the outset that the tool and method described herein are applicable to the removal of a broken bolt shank or other threaded member from a mating tapped hole, as in the case where the head of the bolt is twisted off the threaded shank portion thereof, whether the broken end of the bolt shank is above, flush with, or below the surface defining the tapped hole from which the threaded shank portion is to be extracted. In a preferred embodiment illustrated in FIG. 1, tool 10 of the invention may be used to extract the threaded shank 11 of a broken bolt from tapped hole 12 defined in surface 13 of an element 15 such as an engine cylinder block, automotive housing or other component. Shank 11 is disposed within tapped hole 12 by reason of the bolt of which shank 11 is a part having been previously threaded into tapped hole 12, tightened, and broken at some locus along shank 11. Accordingly, shank 11 has on the outer surface thereof male threads 17 which mate with threads 19 of tapped hole 12.

In a preferred configuration, tool 10 comprises a short segment 21 of substantially fully threaded rod of preselected length and diameter and having on the surface thereof threads 22 of size, type and pitch corresponding to threads 17 on shank 11 and to threads 19 of tapped hole 12. It is noted that the diametric size of segment 21 and the thread type (i.e., coarse, fine, standard, machine, metric, left, or right, etc.) of threads 17 thereon is, according to the teachings hereof, selected to match the size and thread type of shank 11 and tapped hole 12, the same not being limiting of the invention herein. Two nuts 23,24 are provided having internal threads (e.g., 23*a* of nut 23 shown in FIG. 1) mating with threads 22 on segment 21. It will be understood from a further reading hereof that in the performance of one or more of the intended functions of the extractor tool of the invention, one of the nuts (24) serves only to provide an abutting surface against which the other nut (23) is tightened and locked on segment 21 and, accordingly, in one arrangement segment 21 may comprise a bolt having fixed flats replacing nut 24 and being of selected diameter, shank length and thread type. A pair of (off-axis) holes 26,27 are drilled lengthwise of segment 21, substantially as shown in FIG. 1 and are of preselected diameter for receiving corresponding pins 29,30. Pins 29,30 comprise any suitable hardened metal or alloy as would occur to one skilled in the appropriate art area, such as carbon steel, stainless steel, or other metallic material having high shear strength, and have preselected length preferably longer than segment 21 for purposes described hereinafter. It is noted, however, that, as will be seen from a careful consideration of the description of structure and function of the extractor tool of the invention presented herein, it is not essential that pins 29,30 be longer than segment 21 or other equivalent element described below. Screwdriver slot 32 is shown included in the end of segment 21 as representative of means includable thereat for applying torque to segment 21, other applicable means including a wrench flat, Allen wrench cavity or the like in one use of the invention.

Referring now to FIG. 2, shown therein is an exploded view of tool 10 of FIG. 1 in assembly with a component such as cylinder block 35 of an engine having in a surface 37 thereof a tapped hole 39 in which a bolt has been broken off leaving shank 41 to be extracted. Referring additionally to FIG. 3, shown therein is a view of cylinder block 35 and tool 10 in alignment with tapped hole 39 so as to be assembled therewith for removal of shank 41. In utilizing tool 10 for removing the shank of a broken bolt and in accordance with the method of the invention, three separate conditions may exist for the shank within the tapped hole: (a) the bolt may be broken such that the exposed broken end 42 of shank 41 is below surface 37 defining tapped hole 39 (in cylinder block 35 of FIGS. 2,3), or (b) broken end 42 of shank 41 may be substantially flush with surface 37, or (c) a portion of the shank may be exposed above the surface (FIG. 1).

If the bolt is broken off above surface 13 (FIG. 1) such as to expose a portion of threaded shank 11, one nut 23 is first partially threaded onto shank 11 leaving part of the internal threads 23*a* thereof exposed (see FIG. 1) into which segment 21 is threaded into abutment with the broken end of shank 11. (Slot 32 described above may be utilized for threading segment 21 into nut 23 using a standard screwdriver.) Holes 26,27 then provide guides for insertion of an appropriately sized drill bit 45 for drilling holes 33,34 into the broken end of shank 11 in alignment with holes 26,27 in segment 21. Pins 29,30 are then inserted into holes 26,27 and extended into holes 33,34 so that segment 21 and shank 11 are pinned together in axial abutting relationship. Nut 24 is then threaded onto segment 21 and tightened against nut 23. Nuts 23,24 and segment 21 and shank 11 are then backed out as an assembly from tapped hole 12 by gripping and turning nut 23 only.

If the broken end 42 of shank 41 is below surface 37 (FIG. 3), the procedure for removing shank 41 comprises first threading segment 21 into tapped hole 39 into axial abutting relationship with broken end 42 of shank 41. Drilling holes 46,47 into shank 41 using segment 21 as a guide is then performed substantially as described above for the insertion of alignment pins 29,30. Nuts 23,24 are then threaded onto segment 21 into abutting relationship with each other such as suggested in FIG. 3. Applying a wrench then to the flats of the lower nut 23 only and backing it into abutment against nut 24 locks nuts 23,24 together on segment 21 with the result that torque applied to nut 23 is transmitted through pins 29,30 to shank 41. In appropriate situations, a screwdriver may be used in this procedure in manner similar to that described above.

The most difficult operation, as might be expected, is the removal of a broken bolt shank having the broken end thereof flush with surface 39 so that nut 23 cannot be threaded onto shank 11 as in the first above described operation, and segment 21 cannot be threaded into tapped hole 39 as in the second above described operation. In such case, the user must manually hold segment 21 in abutting relationship with broken end 42 of shank 41 until one of the holes (46 or 47) in shank 41 may be drilled. One of the pins 29,30 is then inserted to assist in alignment of segment 21 so that the second hole may be drilled. The second of the pins 29,30 is then inserted, and nuts 23,24 are threaded onto segment 21 into abutting relationship, and shank 41 backed out by gripping and turning lower nut 23 in manner corresponding to the procedure for removing shank 11 where the broken end is above surface 13.

The procedures just described for the removal of the shank of a broken bolt utilizing the invention suggests an extremely useful attribute of the invention which is not characteristic of prior art devices. It is noted that when segment 21 is threaded into axial abutting relationship with the shank of the broken bolt either directly where the broken shank end is below the surface, or with the use of nut 23 where part of the shank is exposed, segment 21 serves as a drill guide for drilling holes into the shank. Removal of broken shanks which are not directly accessible for drilling may be performed using the invention by drilling the alignment holes (33,34 or 46,47) utilizing a drill with a flexible extension on the drill bit for drilling at an angle to the axis of the drill chuck. Such an operation was performed in demonstration of the invention wherein alignment holes were successfully drilled utilizing a flexible extension (drill bit welded to a piece of welding rod) at about 90° to the axis of the drill chuck. A similar operation may be performed, although with somewhat more difficulty, where the bolt is broken off flush with the surface of the tapped hole.

It is apparent in view of the foregoing teachings that suitable pinning of the threaded segment in axial abutment with the shank of the broken bolt to be extracted is important to successful functioning of the invention. It is noted that at least two such pins as described above is needed. Use of only one off-axis pin usually results in throwing the broken shank, segment and alignment pin into a bind within the tapped hole. Referring now, however, to FIG. 4, shown therein is an exploded view of another embodiment 10' of the invention utilizing three off-axis alignment pins 49,50,51 in place of the two included in the FIG. 1 embodiment. The FIG. 4 embodiment comprising three alignment pins should clearly be a more rugged configuration though correspondingly less convenient to use than the FIG. 1 embodiment since an additional hole must be drilled. It is suggested that additional (four or more) alignment pins may not provide correspondingly increased strength for the extractor tool and may not be preferred arrangements, although any number of alignment pins is considered within the scope of these teachings.

It is therefore seen that the invention described herein provides a novel and highly useful tool and method for removing a broken bolt from a tapped hole into which it is threaded. As suggested above, the tool of the invention may be sized to correspond to substantially any bolt size and thread type, and the invention may therefore be particularly useful as a set in a range of such bolt and/or thread sizes and types. It is understood therefore that modifications to the invention may be made by one with skill in the field of the invention guided by these teachings within the scope of the appended claims, such modifications considered to be within the scope of the invention as defined in the claims.

I claim:

1. A tool for extracting a threaded member from a tapped hole, comprising:

(a) a segment of substantially fully threaded rod of preselected length and having diameter and threads defined thereon corresponding to that of said threaded member and tapped hole;

(b) a plurality of off-axis longitudinal holes of preselected diameter defined through said segment for use as drill guides for drilling holes in said threaded member;

(c) a plurality of elongate pins for insertion into respective said holes in said segment and in said threaded member, said pins sized for slip fit into said off-axis longitudinal holes; and (d) means defined in one end of said segment for applying torque to said segment.

2. The tool as recited in claim 1 wherein said means in one end of said segment for applying torque to said segment includes a screwdriver slot.

3. The tool as recited in claim 1 comprising two said off-axis longitudinal holes and two said elongate pins.

4. A tool for extracting a threaded member from a tapped hole, comprising:

(a) a segment of substantially fully threaded rod of preselected length and having diameter and threads defined thereon corresponding to that of said threaded member and tapped hole;

(b) a plurality of off-axis longitudinal holes of preselected diameter defined through said segment for use as drill guides for drilling holes in said threaded member;

(c) a plurality of elongate pins for insertion into respective said holes in said segment and in said threaded member, said pins sized for slip fit into said off-axis longitudinal holes; and (d) a pair of nuts threadably received by said segment for applying torque to said segment.

5. The tool as recited in claim 4 further comprising means defined in one end of said segment for applying torque to said segment.

6. The tool as recited in claim 5 wherein said means in one end of said segment for applying torque to said segment includes a screwdriver slot.

7. A tool for extracting a threaded member from a tapped hole, comprising:

(a) a bolt having a threaded shank portion of preselected length and having diameter and threads defined thereon corresponding to that of said threaded member and tapped hole, said bolt further including a head defining wrench flats for applying torque thereto;

(b) a plurality of off-axis longitudinal holes of preselected diameter defined through said bolt for use as drill guides for drilling holes in said threaded member; and (c) a plurality of elongate pins for insertion into respective said holes in said bolt and in said threaded member, said pins sized for slip fit into said off-axis longitudinal holes.

8. The tool as recited in claim 7 further comprising a nut threadably received by said bolt.

9. A method for extracting from a tapped hole a threaded member presenting an end surface situated below the surface defining said tapped hole, said method comprising the steps of:

(a) providing a segment of threaded rod of preselected length and having diameter and threads defined thereon corresponding to that of said threaded member and tapped hole, said segment having defined therethrough a plurality of off-axis longitudinal holes of preselected diameter;

(b) threading said segment into said tapped hole substantially into axial abutment with said threaded member;

(c) drilling a plurality of holes of said preselected diameter into said end surface of said threaded member using said off-axis holes as drill guides;

(d) inserting a plurality of elongate pins into respective said holes in said segment and said holes in said end surface of said threaded member; and (e) applying torque to said segment to threadably remove said segment and said threaded member from said tapped hole.

10. A method for extracting from a tapped hole a threaded member presenting an end surface situated substantially flush with the surface defining said tapped hole, said method comprising the steps of:

(a) providing a segment of threaded rod of preselected length and having diameter and threads defined thereon corresponding to that of said threaded member and tapped hole, said segment having defined therethrough a plurality of off-axis longitudinal holes of preselected diameter;

(b) holding said segment in axial abutting relationship against said end surface of said threaded member;

(c) drilling a first hole of said preselected diameter into said end surface of said threaded member using one of said off-axis holes as a drill guide;

(d) inserting an elongate pin into said one of said off-axis holes in said segment and into the corresponding hole in said end surface of said threaded member to hold said segment in substantial axial alignment with said threaded member;

(e) drilling additional holes in said end surface of said threaded member corresponding in number to said plurality of off-axis longitudinal holes in said segment using said longitudinal holes as drill guides;

(f) inserting additional elongate pins through the remaining said off-axis holes in said segment into said additional holes in said end surface of said threaded member; and (g) applying torque to said segment to threadably remove said threaded member from said tapped hole.

11. The tool as recited in claim 1 wherein said means in one end of said segment for applying torque to said segment includes a set of wrench flats.

12. The tool as recited in claim 5 wherein said means in one end of said segment for applying torque to said segment includes a set of wrench flats.

13. A method for extracting from a tapped hole a threaded member presenting an end surface situated above the surface defining said tapped hole, said method comprising the steps of:

(a) providing a segment of threaded rod of preselected length and having diameter and threads defined thereon corresponding to that of said threaded member and tapped hole, said segment having defined therethrough a plurality of off-axis longitudinal holes of preselected diameter;

(b) providing an internally threaded element having along the length thereof threads defined therein corresponding to that of said threaded member and tapped hole;

(c) threading said internally threaded element onto said threaded member to less than the full thread length of said internally threaded element;

(d) threading said segment into said internally threaded element substantially into axial abutting relationship with said end surface of said threaded member;

(e) drilling a plurality of holes of said preselected diameter into said end surface of said threaded member using said off-axis holes as drill guides;

(f) inserting a plurality of elongate pins into respective said holes in said segment and said holes in said end surface of said threaded member; and (g) applying torque to said segment to threadably remove said threaded member from said tapped hole.

* * * * *